US005284532A

United States Patent [19]

Skinner

[11] Patent Number: 5,284,532

[45] Date of Patent: Feb. 8, 1994

[54] ELEVATED TEMPERATURE STRENGTH OF ALUMINUM BASED ALLOYS BY THE ADDITION OF RARE EARTH ELEMENTS

[75] Inventor: David J. Skinner, Long Valley, N.J.

[73] Assignee: Allied Signal Inc., Morristown, N.J.

[21] Appl. No.: 4,471

[22] Filed: Jan. 14, 1993

Related U.S. Application Data

[63] Continuation of Ser. No. 835,814, Feb. 18, 1992, abandoned.

[51] Int. Cl.[5] ..... C22F 1/04

[52] U.S. Cl. ..... 148/549; 148/437; 419/66; 420/548; 420/550; 420/551; 420/552; 420/553

[58] Field of Search ..... 148/437, 549; 420/548, 420/550, 551, 552, 553, 590; 419/60, 66, 67, 68, 69

[56] References Cited

U.S. PATENT DOCUMENTS

| | | | |
|---|---|---|---|
| 2,963,780 | 12/1960 | Lyle et al. | 420/550 |
| 2,967,351 | 1/1961 | Roberts et al. | 419/38 |
| 3,462,248 | 8/1969 | Roberts et al. | 420/550 |
| 4,379,719 | 4/1983 | Hildeman et al. | 419/60 |
| 4,743,317 | 5/1988 | Skinner et al. | 148/437 |
| 4,828,632 | 5/1989 | Adam et al. | 148/437 |
| 4,878,967 | 11/1989 | Adam et al. | 148/437 |
| 4,879,095 | 11/1989 | Adam et al. | 420/548 |
| 4,948,558 | 8/1990 | Skinner et al. | 420/548 |

OTHER PUBLICATIONS

Gogia et al., "Rapidly Solidified Aluminium-Iron-misch metal alloys", J. Mat. Science, 20, pp. 3091-3100 (1985).

Savage et al., "Microstructural characterization of as--cast rapidly solidified al-sm, al-gd and al-er binary alloys", Proc. of Structural Metals . . . , Conf. Proc. ASM Mat. Week '86, Orlando, Fla., ASM International, pp. 351-356 (1986).

Mahajan et al., "Rapidly solidified microstructure of Al-8Fe-4 lanthanide alloys" J. of Mat. Science, 22, pp. 202-206 (1987).

Ruder et al., "Microstructure and thermal stability of a rapidly solidified Al-4Er alloy", J. Mat. Science, 25, pp. 3541-3545 (1990).

Sivaramakrishnan et al., "Characterization of rapidly solidified structures of Al-6Fe-3MM", J. of Mat. Science, 26, pp. 4369-4374 (1991).

*Primary Examiner*—Richard O. Dean
*Assistant Examiner*—Robert R. Koehler
*Attorney, Agent, or Firm*—Ernest D. Buff; Gerhard H. Fuchs

[57] ABSTRACT

A rapidly solidified aluminum based alloy consists essentially of the formula $Al_{bal}Fe_aM_bSi_cR_d$, wherein M is at least one element selected from the group consisting of V, Mo, Cr, Mn, Nb, Ta, and W; R is at least one element selected from the group consisting of La, Ce, Pr, Nd, Sm, Gd, Dy, Er, Yb, and Y; "a" ranges from 3.0 to 7.1 atom %; "b" ranges from 0.25 to 1.25 atom %; "c" ranges from 1.0 to 3.0 atom %; "d" ranges from 3.0 to 0.3 atom % and the balance is aluminum plus incidental impurities, with the provisos that (i) the ratio [Fe+M]:Si ranges from about 2.0:1 to 5.0:1 and (ii) the ratio Fe:M ranges from about 16:1 to 5:1. The alloy exhibits improved elevated temperature strength due to the rare earth element additions without an increase in the volume fraction of dispersed intermetallic phase precipitates therein. This enhancement of elevated temperature strength makes the alloys of the invention especially suited for use in high temperature structural applications such as gas turbine engines, missiles, airframes and landing wheels.

11 Claims, No Drawings

ELEVATED TEMPERATURE STRENGTH OF ALUMINUM BASED ALLOYS BY THE ADDITION OF RARE EARTH ELEMENTS

This application is a continuation of application Ser. No. 835,814 filed Feb. 18, 1992, now abandoned.

BACKGROUND OF THE INVENTION

1. Field of the Invention

The invention relates to aluminum based alloys having improved strength at elevated temperatures through the addition of rare earth elements, and to powder products produced from such alloys. More particularly, the invention relates to Al-Fe-Si-X-RE alloys (RE signifies rare earth elements) that have been rapidly solidified from the melt and thermomechanically processed into structural components having improved elevated temperature strength.

2. Brief Description of the Prior Art

Methods of obtaining improved tensile strength in aluminum based alloys have been taught by U.S. Pat. No. 2,963,780 to Lyle et al.; U.S. Pat. Nos. 2,967,351and 3,462,248 to Roberts et al.; and U.S. Pat. Nos. 4,828,632, 4,878,967 and 4,879,095 to Adam et al. However, these teachings alloys propose increasing quantities of transition element and/or higher cooling rates during casting of the alloys for the elevated temperature strength thereof to be increased. It would be desirable if rare earth elements could be added to rapidly cooled alloys containing transition metal elements to improve the elevated temperature strength without the necessity of forming further intermetallics or increasing the quench rate. Yet, prior art workers have heretofore not pursued this course.

The addition of rare earths to aluminum has been attempted by U.S. Pat. No. 4,379,719 to Hilderman et al., where rapidly quenched aluminum alloy powder contains 4 to 12 wt% iron and 1 to 7 wt% cerium or other rare earth metals from the lanthanum series. Other examples of rare earth additions include: A.K. Gogia et al.; J. of Mat. Science, 20, pp. 3091-3100 (1985); S.J. Savage et al.; Processing of Structural Metals by Rapid Solidification, Conf. Proc. ASM Materials Week '86 Orlando, FL, Ed. F.H. Froes and S.J. Savage, ASM International, pp. 351-356 (1986); Y.R. Mahajan et al., J. of Mat. Science, 22, pp. 202-206 (1987); A. Ruder et al., J. of Mat. Science, 25, pp. 3541-3545 (1990) and C.S. Sivaramakrishnan et al., J. of Mat. Science, 26, pp. 4369-4374 (1991). However, these rare earth additions are integral in the formation of the strengthening intermetallics having general composition $Al_xFe_yRe_z$ (where Re refers to the rare earth).

There remains a need in the art for rapidly solidified aluminum base alloys having improved elevated temperature strengths.

3. Summary of the Invention

The present invention provides rapidly solidified aluminum base alloys wherein elevated temperature strengths are markedly improved without the necessity of increasing the volume fraction of intermetallics therewithin. Generally stated, the aluminum based alloy of the invention consists essentially of the formula $Al_{bal}Fe_aM_bSi_cR_d$, wherein M is at least one element selected from the group consisting of V, Mo, Cr, Mn, Nb, Ta, and W; R is at least one element selected from the group consisting of La, Ce, Pr, Nd, Sm, Gd, Dy, Er, Yb, and Y, "a" ranges from 3.0 to 7.1 atom %; "b" ranges from 0.25 to 1.25 atom %; "c" ranges from 1.0 to 3.0 atom %; "d" ranges from 0.02 to 0.3 atom % and the balance is aluminum plus incidental impurities, with the provisos that (i) the ratio [Fe+M]:Si ranges from about 2.0:1 to 5.0:1 and (ii) the ratio Fe:M ranges from about 16:1 to 5:1.

To provide the desired levels of ductility, toughness and strength needed for commercially useful applications, the alloys of the invention are subject to rapid solidification processing, which modifies the alloy's microstructure. The rapid solidification processing method is one wherein the alloys are placed into the molten state and then cooled at a quench rate of at least about $10^5$°$Cs^{-1}$ and preferably about $10^5$ to $10^7$°$Cs^{-1}$ to form a solid substance. More preferably this method should cool the molten metal at a rate greater than about $10^6$°$Cs^{-1}$ i.e. via melt spinning, splat cooling or planar flow casting which forms a solid ribbon or sheet. These alloys have an as cast microstructure which varies from a microeutectic to a microcellular structure, depending on the specific alloy chemistry. In alloys of the invention the relative proportion of these structures is not critical.

Consolidated articles of the invention are produced by compacting particles composed of an aluminum based alloy consisting essentially of the formula $Al_{bal}Fe_aM_bSi_cR_d$, wherein M is at least one element selected from the group consisting of V, Mo, Cr, Mn, Nb, Ta and W; R is at least one element selected from the group consisting of La, Ce, Pr, Nd, Sm, Gd, Dy, Er, Yb and Y; "a" ranges from 3.0 to 7.1 atom %; "b" ranges from 0.25 to 1.25 atom %; "c" ranges from 1.0 to 3.0 atom %; "d" ranges from 0.02 to 0.3 atom % and the balance is aluminum plus incidental impurities, with the provisos that (i) ratio [Fe+M]:Si ranges from about 2.0:1 to 5.0:1 and (ii) the ratio Fe:M ranges from about 16:1 to 5:1. The particles are heated in a vacuum during the compacting step to a pressing temperature ranging from about 300° C. to 500° C., which minimizes coarsening of the dispersed intermetallic phases. Alternatively, the particles are put in a can which is then evacuated, heated to between 300° C. and 500° C. and then sealed. The sealed can is heated to between 300° C. and 500° C. in ambient atmosphere and compacted. The compacted article is further consolidated by conventional methods such as extrusion, rolling or forging.

The consolidated article is composed of an aluminum solid solution phase containing a substantially uniform distribution of dispersed intermetallic phase precipitates of approximate composition $Al_{13}(Fe,M)_3Si$. These dispersoids are fine intermetallics measuring less than 100 nm in all linear dimensions thereof. Alloys of the invention, containing these fine dispersed intermetallics are capable of withstanding the pressures and temperatures associated with conventional consolidation and forming techniques such as forging, rolling and extrusion without substantial growth or coarsening of these intermetallics that would otherwise reduce the strength and ductility of the consolidated article to unacceptably low levels. The rare earth elements added to the alloys of the invention do not form any new intermetallic phases therein; but instead substantially stay in solid solution of the aluminum matrix phase. At elevated temperatures in excess of approximately 260° C. the action of the rare earth elements in the aluminum solid solution is to impede the motion of dislocations around the dispersed intermetallic phase through the retardation of the climb process necessary for these dislocations to circumvent the dispersed intermetallic phase therein. This retardation process causes a marked increase in strength of the material at these elevated temperatures, such strength increase ranges from about 5 to 15 percent.

Advantageously, the improved elevated temperature strength of articles produced in accordance with the invention makes such articles especially suited for use in gas turbine engines, missiles, airframes, landing wheels, and the like.

DESCRIPTION OF THE PREFERRED EMBODIMENTS

To provide the desired levels of strength, ductility, elastic modulus and toughness needed for commercially useful applications, rapid solidification processing is particularly effective for producing these aluminum based alloys. The alloys of the invention consist essentially of the formula $Al_{bal}Fe_aM_bSi_cR_d$, wherein M is at least one element selected from the group consisting of V, Mo, Cr, Mn, Nb, Ta, and W; R is at least one element selected from the group consisting of La, Ce, Pr, Nd, Sm, Gd, Dy, Er, Yb, and Y; "a" ranges from 3.0 to 7.1 atom %; "b" ranges from 0.25 to 1.25 atom %; "c" ranges from 1.0 to 3.0 atom %; "d" ranges from 0.02 to 0.3 atom % and the balance is aluminum plus incidental impurities, with the provisos that (i) the ratio [Fe+M]-:Si ranges from about 2.0:1 to 5.0:1 and (ii) the ratio Fe:M ranges from about 16:1 to 5:1. The rapid solidification process typically employs a casting method wherein the alloy is placed into a molten state and then cooled at a quench rate of at least about $10^5$°$Cs^{-1}$ and preferably $10^5$ to $10^7$°$Cs^{-1}$ on a rapidly moving casting substrate to form a solid ribbon or sheet. This process should provide provisos for protecting the melt puddle from burning, excessive oxidation and physical disturbances by the moving air boundary layer carried along with the moving casting surface. For example, this protection can be provided by shrouding apparatus which contains a protective gas, such as a mixture of air or $CO_2$ and $SF_6$, a reducing gas such as CO, or an inert gas such as argon, around the nozzle. In addition, the shrouding apparatus excludes extraneous wind currents which might disturb the melt puddle.

Rapidly solidified alloys having the $Al_{bal}Fe_aM_bSi_cR_d$ compositions (with the [Fe+M]:Si ratio and Fe:M ratio provisos) described above have been processed into ribbons and then formed into particles by conventional comminution devices such as pulverizers, knife mills, rotating hammar mills and the like. Preferably, the comminuted particles have a size ranging from about −40 to +200 mesh, U.S. standard sieve size.

The particles are placed in a vacuum of less than $10^{-4}$ torr ($1.33\times10^{-2}$Pa) preferably less than $10^{-5}$ torr ($1.33\times10^{-3}$Pa), and then compacted by conventional powder metallurgy techniques. In addition the particles are heated at a temperature ranging from about 300° C. to 550° C., preferably ranging from about 325° C. to 450° C., minimizing the growth or coarsening of the intermetallic phases therein. The heating of the powder particles preferably occurs during the compacting step. Suitable powder metallurgy techniques include direct powder extrusion by putting the powder in a can which has been evacuated and sealed under vacuum, vacuum hot compaction, blind die compaction in an extrusion or forming press, direct and indirect extrusion, conventional impact forging, impact extrusion and combinations of the above.

The compacted consolidated article of the invention is composed of a substantially homogeneous dispersion of very small intermetallic phase precipitates within the aluminum solid solution matrix. The dispersed intermetallics are fine, usually spherical in shape, measuring less than about 100 nm in all linear dimensions thereof. The volume fraction of these fine intermetallic precipitates ranges from about 10 to 50%, and preferably, ranges from about 15 to 37%. Volume fractions of coarse intermetallic precipitates (i.e. precipitates measuring more than about 100 nm in all linear dimensions thereof) is not more than about 1%.

Composition of the fine intermetallic precipitates found in the consolidated article of the invention is approximately $Al_{13}(Fe,M)_3Si$. For alloys of the invention this intermetallic composition range represents about 100% of the fine dispersed intermetallic precipitates found in the consolidated article. The addition of V, Mo, Cr, Mn, Nb, Ta and/or W elements, comprising the M component of the alloy composition defined hereinabove by the formula $Al_{bal}Fe_aM_bSi_cR_d$ (with the [Fe+M]:Si ratio and the Fe:M ratio provisos) stabilizes the quaternary silicide intermetallic precipitate, resulting in a general composition of about $Al_{13}(Fe,M)_3Si$. The [Fe+M]:Si and Fe:M ratio provisos define the composition boundaries within which 100% of the fine dispersed intermetallic phases are of this general composition. The preferred stabilized intermetallic precipitate structure is cubic (body centered cubic) with a lattice parameter that is about 1.25nm to 1.28nm.

Alloys of the invention, containing these fine dispersed intermetallic precipitates, are able to withstand the heat and pressures of conventional powder metallurgy techniques without excessive growth or coarsening of the intermetallics that would otherwise reduce the strength and ductility to unacceptably low levels. In addition, alloys of the invention are able to tolerate unconventionally high processing temperatures and withstand long exposure times at high temperatures during processing. Such temperatures and times are encountered during the production of near net-shape articles by forging and sheet or plate by rolling, for example. As a result, alloys of the invention are particularly advantageous because they can be compacted over a broad range of consolidation temperatures and still provide the desired combinations of strength and ductility in the compacted article.

Further, by ensuring that 100% of the fine dispersed intermetallic phases are of the general composition $Al_{13}(Fe,M)_3Si$ by the application of the [Fe+M]:Si and Fe:M ratio provisos, increases in applicable engineering properties can be achieved.

The addition of rare earth elements within the alloys of the invention do not form any new intermetallic phases therein, nor do they combine with any existing dispersed intermetallic phase precipitates. Instead, the rare earth elements, when added to alloys described by the formula $Al_{bal}Fe_aM_bSi_cR_d$, with the [Fe+M]:Si ratio and the Fe:M ratio provisos defined hereinabove, operate to increase the strength of the material by staying substantially in the solid solution of the aluminum matrix phase. At ambient temperature and temperatures below approximately 260° C., the action of the rare earth additive is benign in that the motion of dislocations within the aluminum matrix solid solution phase is substantially along atomic lattice planes and the strength of the alloy is defined through interactions with the fine dispersed intermetallic phases and these dislocations. At temperatures above approximately 260° C. the action of the rare earth elements in the aluminum solid solution matrix phase is to impede the motion of dislocations around the dispersed intermetallic phases through the retardation of the climb processes necessary for these said dislocations to circumvent the dispersed intermetallic phase therein. This retardation process causes the increase in strength at these elevated temperatures that constitutes the uniqueness of this invention.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES 1 TO 12

Alloys of the invention were cast according to the formula and method of the invention and are listed in Table 1.

TABLE 1

| | |
|---|---|
| 1. | $Al_{92.95}Fe_{4.35}V_{0.73}Si_{1.73}Y_{0.24}$ |
| 2. | $Al_{93.032}Fe_{4.354}V_{0.73}Si_{1.731}Ce_{0.153}$ |
| 3. | $Al_{93.047}Fe_{4.355}V_{0.73}Si_{1.732}Gd_{0.136}$ |
| 4. | $Al_{93.055}Fe_{4.355}V_{0.73}Si_{1.732}Er_{0.128}$ |
| 5. | $Al_{93.03}Fe_{4.354}V_{0.73}Si_{1.731}La_{0.154}$ |
| 6. | $Al_{93.036}Fe_{4.354}V_{0.73}Si_{1.732}Nd_{0.149}$ |
| 7. | $Al_{93.041}Fe_{4.354}V_{0.73}Si_{1.732}Sm_{0.143}$ |
| 8. | $Al_{93.112}Fe_{4.345}V_{0.73}Si_{1.728}Er_{0.085}$ |
| 9. | $Al_{92.091}Fe_{4.86}V_{0.798}Si_{1.964}W_{0.20}Er_{0.087}$ |
| 10. | $Al_{91.971}Fe_{4.882}V_{0.80}Si_{1.973}W_{0.20}Er_{0.174}$ |
| 11. | $Al_{91.679}Fe_{5.162}V_{0.80}Si_{2.074}W_{0.198}Er_{0.087}$ |
| 12. | $Al_{91.555}Fe_{5.185}V_{0.803}Si_{2.083}W_{0.199}Er_{0.175}$ |

EXAMPLES 13 TO 15

Table 2 below shows the mechanical properties of specific alloys of the invention compared to alloys of similar composition but excluding the rare earth elements and, therefore, being outside the scope of the invention. The properties were measured in uniaxial tension at a strain rate of approximately $5X10^{-4}s^{-1}$ at a temperature of 375° C. Each selected alloy powder of the invention, and those not of the invention, were vacuum hot pressed at a temperature of 350° C. for 1 hour to produce a 95 to 100% density preform slug. These slugs were extruded into rectangular bars with an extrusion ratio of 18:1 at 345° to 385° C. after holding at that temperature for 1 hour. The comparison between the rare earth containing alloys and those alloys outside the scope of this invention indicates that alloys of the invention exhibit an increase in the tensile yield strength (YS) and ultimate tensile strength (UTS) without an increase in volume fraction of the dispersed intermetallic phases present in each alloy.

TABLE 2

| Alloy; at % [wt %] | YS [MPa] | UTS [MPa] | Vol. Frac. |
|---|---|---|---|
| $Al_{93.112}Fe_{4.345}V_{0.73}Si_{1.728}Er_{0.085}$ [Al—8.5%Fe—1.3%V—1.7%Si—0.5%Er] | 187 | 192 | 0.27 |
| $Al_{93.22}Fe_{4.33}V_{0.73}Si_{1.73}$ [Al—8.5%Fe—1.3%V—1.7%Si] | 171 | 172 | 0.27 |
| $Al_{92.091}Fe_{4.86}V_{0.798}Si_{1.964}W_{0.20}Er_{0.087}$ [Al—9.35%Fe—1.4%V—1.9%Si—1.25%W—0.5%Er] | 215 | 221 | 0.30 |
| $Al_{92.217}Fe_{4.838}V_{0.794}Si_{1.955}W_{0.196}$ [Al—9.35%Fe—1.4%V—1.9%Si—1.25%W] | 204 | 206 | 0.30 |
| $Al_{91.555}Fe_{5.185}V_{0.803}Si_{2.083}W_{0.199}Er_{0.175}$ [Al—9.9%Fe—1.4%V—2.0%Si—1.25%W—1.0%Er] | 227 | 235 | 0.32 |
| $Al_{91.804}Fe_{5.138}V_{0.797}Si_{2.064}W_{0.197}$ [Al—9.9%Fe—1.4%V—2.0%Si—1.25%W] | 215 | 219 | 0.32 |

Having thus described the invention in rather full detail, it will be understood that these details need not be strictly adhered to but that various changes and modifications may suggest themselves to one skilled in the art, all falling within the scope of the invention as defined by the adjoining claims.

I claim:

1. A rapidly solidified aluminum based alloy consisting essentially of the formula $Al_{bal}Fe_aM_bSi_cR_d$, wherein M is at least one element selected from the group consisting of V, Mo, Cr, Mn, Nb, Ta and W; R is Er; "a" ranges from 3.0 to 7.1 atom %, "b" ranges from 0.25 to 1.25 atom %, "c" ranges from 1.0 to 3.0 atom %, "d" ranges from 0.02 to 0.3 atom % and the balance is aluminum plus incidental impurities, with the provisos that (i) the ratio [Fe+M]:Si ranges from about 2.0:1 to 5.0:1 and (ii) the ratio Fe:M ranges from about 16:1 to 5:1, said alloy having an aluminum solid solution phase wherein each R group element is in solid solution and about 100 percent of dispersed intermetallic percipitates are of approximate composition $Al_{13}(Fe,M)_3Si$ and are substantially uniformly distributed.

2. A method for making an aluminum based alloy, comprising the steps of:

(a) forming a melt of said alloy in a protective environment, said alloy consisting essentially of the formula $Al_{bal}Fe_aM_bSi_cR_d$, wherein M is at least one element selected from the group consisting of V, Mo, Cr, Mn, Nb, Ta and W; R is Er; "a" ranges from 3.0 to 7.1 atom %; "b" ranges from 0.25 to 1.25 atom %; "c" ranges from 1.0 to 3.0 atom %; "d" ranges from 0.02 to 0.3 atom % and the balance is aluminum plus incidental impurities, with the provisos that (i) the ratio [Fe+M]:Si ranges from about 2.0:1 to 5.0:1, and (ii) the ratio of Fe:M ranges from about 16:1 to 5:1; and (b) quenching said melt in said protective environment at a rate of at least about $10^5$°$Cs^{-1}$ by directing said melt into contact with a rapidly moving quench surface to form thereby a rapidly solidified ribbon or sheet of said alloy having an aluminum solid solution phase wherein each R group element is in solid solution and about 100 percent of dispersed intermetallic precipitates are of approximate composition $Al_{13}(Fe,M)_3Si$ and are substantially uniformly distributed.

3. A method of forming a consolidated metal alloy article in which particles composed of an aluminum based alloy consisting essentially of the formula $Al_{bal}Fe_aM_bSi_cR_d$, wherein M is at least one element selected from the group consisting of V, Mo, Cr, Mn, Nb, Ta and W; R is Er; "a" ranges from 3.0 to 7.1 atom %; "b" ranges from 0.25 to 1.25 atom %; "c" ranges from 1.0 to 3.0 atom %; "d" ranges from 0.02 to 0.03 atom % and the balance is aluminum plus incidental impurities, with the provisos that (i) the ratio [Fe+M]:Si ranges from about 2.0:1 to 5.0:1 and (ii) the ratio Fe:M ranges from about 16:1 to 5:1 are heated in a vacuum to a temperature ranging from about 300° C. to 500° C. and compacted, said alloy having an aluminum solid solution phase wherein each R group element is in solid solution and about 100 percent of dispersed intermetallic precipitates are of approximate composition $Al_{13}(Fe,M)_3Si$ and are substantially uniformly distributed.

4. A method as recited in claim 3, wherein said heating step comprises heating said particles to a temperature ranging from 325° C. to 450° C.

5. A method for forming a consolidated metal article comprising the steps of:

(a) degassing particles composed of an aluminum based alloy consisting essentially of the formula $Al_{bal}Fe_aM_bSi_cR_d$, wherein M is at least one element selected from the group consisting of V, Mo, Cr, Mn, Nb, Ta and W; R is Er; "a" ranges from 3.0 to 7.1 atom %; "b" ranges from 0.25 to 1.25 atom %; "c" ranges from 1.0 to 3.0 atom %; "d" ranges from 0.02 to 0.03 atom % and the balance is aluminum plus incidental impurities, with the provisos that (i) the ratio [Fe+M]:Si ranges from about 2.0:1 to 5.0:1 and (ii) that the ratio Fe:M ranges from about 16:1 to 5:1 by placing said particles in a container, heating said container and particles to a temperature ranging from about 300° C. to 500° C, evacuating said container and sealing said container under vacuum; and (b) consolidating said particles by heating said container and particles to a temperature ranging from 300° C. to 500° C. and compacting said container and particles into a billet, said alloy having an aluminum solid solution phase wherein each R group element is in solid solution and about 100 percent of dispersed intermetallic precipitates are of approximate composition $Al_{13}(Fe,M)_3Si$ and are substantially uniformly distributed.

6. A method as recited in claim 5, wherein said heating step comprises heating said container and particles to a temperature ranging from 325° C. to 450° C.

7. A consolidated metal article compacted from particles of an aluminum based alloy consisting essentially of the formula $Al_{bal}Fe_aM_bSi_cR_d$, wherein M is at least one element selected from the group consisting of V, Mo, Cr, Mn, Nb, Ta, and W; R is Er; "a" ranges from 3.0 to 7.1 atom %; "b" ranges from 0.25 to 1.25 atom %; "c" ranges from 1.0 to 3.0 atom %; "d" ranges from 0.02 to 0.03 atom % and the balance is aluminum plus incidental impurities, with the provisos that (i) the ratio [Fe+M]:Si ranges from about 2.0:1 to 5.0:1 and (ii) the ratio Fe:M ranges from about 16:1 to 5:1 said consolidated article being composed of an aluminum solid solution phase wherein each R group element is in solid solution and about 100 percent of dispersed intermeatllic percipitates are of approximate composition $Al_{13}$-$(Fe,M)_3Si$ and are substantially uniformly distributed, and each of said precipitates measures less than about 100 nm in any linear dimension thereof.

8. A consolidated metal article as recited in claim 7, wherein the volume fraction of said fine dispersed intermetallic phase precipitates ranges from about 10 to 50%.

9. A consolidated metal article as recited in claim 7, wherein said article is compacted by forging without substantial loss in mechanical properties.

10. A consolidated metal article as recited in claim 7, wherein said article is compacted by extruding through a die into bulk shapes.

11. A consolidated metal article as recited in claim 7, wherein said article has the form of sheet having a width of at least 0.5" (12 mm) and a thickness of at least 0.010" (2 mm).

* * * * *